United States Patent [19]

Jacoff

[11] Patent Number: 4,930,218

[45] Date of Patent: Jun. 5, 1990

[54] UTILITY KNIFE

[75] Inventor: Daniel Jacoff, Mineola, N.Y.

[73] Assignee: Great Neck Saw Manufacturers, Inc., Mineola, N.Y.

[21] Appl. No.: 337,479

[22] Filed: Apr. 13, 1989

[51] Int. Cl.[5] ..... B26B 3/03; B26B 3/06

[52] U.S. Cl. ..... 30/162; 30/161

[58] Field of Search ..... 30/160, 161, 162

[56] References Cited

U.S. PATENT DOCUMENTS

| | | | |
|---|---|---|---|
| 3,316,635 | 5/1964 | Merrow et al. | 30/162 |
| 3,381,807 | 5/1968 | Vaughn | 30/162 |
| 4,063,356 | 12/1977 | Hepworth | 30/162 |
| 4,196,515 | 4/1980 | Sugiyama | 30/162 |
| 4,277,888 | 7/1981 | Szabo | 30/162 |
| 4,761,882 | 8/1988 | Silverstein | 30/162 |

*Primary Examiner*—Douglas D. Watts
*Assistant Examiner*—Paul M. Heyrana, Sr.
*Attorney, Agent, or Firm*—Stoll, Previto & Hoffman

[57] ABSTRACT

A utility knife having a main body formed from a pair of body portions which are assembled together. The main body has an opening at the front with means to prevent the pair of body portions from spreading apart and with means to prevent the blade from swaying from side to side.

4 Claims, 1 Drawing Sheet

UTILITY KNIFE

DESCRIPTION

The present invention relates to a utility knife and more particularly to a utility knife which has a retractable knife blade extending from its forward end.

In the past, utility knives have been assembled from two matching portions or halves within which there is provided a carrier for a knife blade. The two matching portions are adapted to interfit with each other to form the body of the tool and to be held together by any suitable means, such as screws. The two matching portions have spaces at their front ends in order to form an open mouth. Mounted within the matching portions is a blade carrier which is adapted to move forwardly in order to project the blade through the front open mouth to permit the tool to be used and to move backwardly to retract the blade within the two matching portions when the tool is no longer in use.

One of the problems in this type of a structure is that the front ends of the two matching portions which form the mouth tend to spread out when the tool is being used. This spreading action not only prevents the tool from making an accurate cut, but more importantly, may allow the blade to be forced out of the front end of the tool and to cause injury to the user.

Another drawback with existing knives is the fact that the blade may fluctuate from side to side creating a potentially dangerous situation for the user.

Another object of the present invention is a provision of the improved utility knife in which means are provided whereby the knife is held in a steady position at the mouth and cannot fluctuate from side to side.

Another object of the present invention is the provision of the utility knife in which the two halves made into two matching one piece units which can be easily assembled together.

Other and further objects of the invention will be obvious upon an understanding of the illustrative embodiment about to be described or will be indicated in the appended claims, and various advantages not referred to herein will occur to one skilled in the art upon employment of the invention in practice.

A preferred embodiment of the invention has been chosen for purposes of illustration and description and is shown in the accompanying drawings forming a part of the specification wherein.

Figure 1:
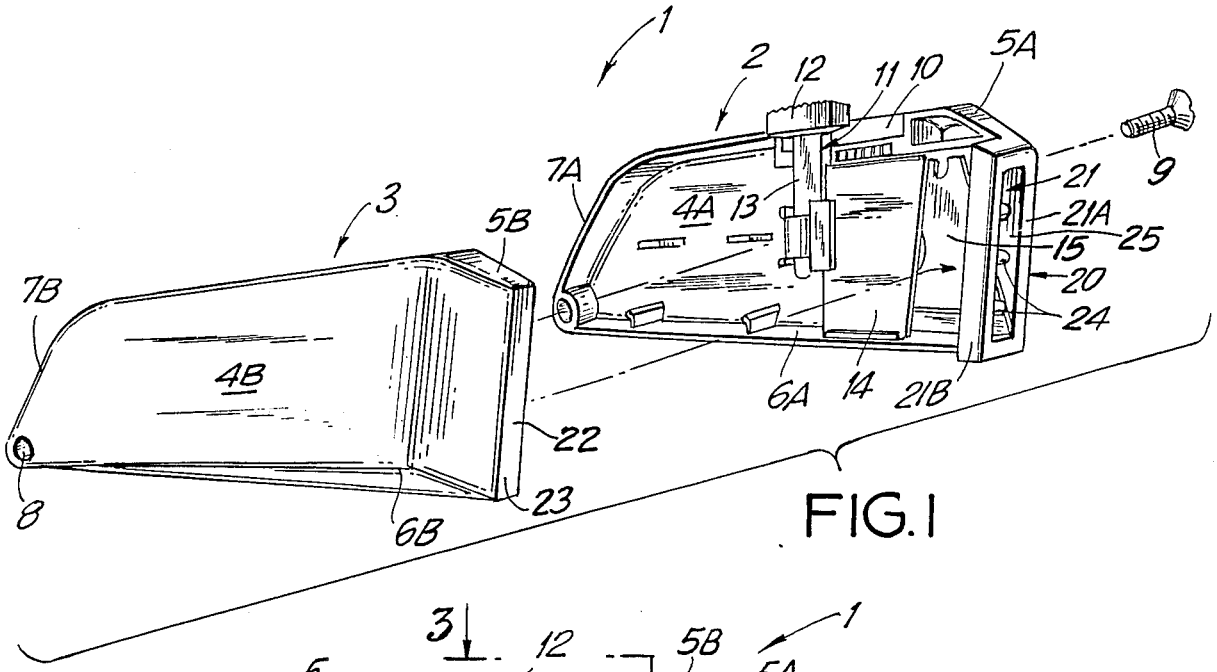
FIG. 1 is an exploded perspective view showing a utility knife made in accordance with the present invention.
Figure 2:
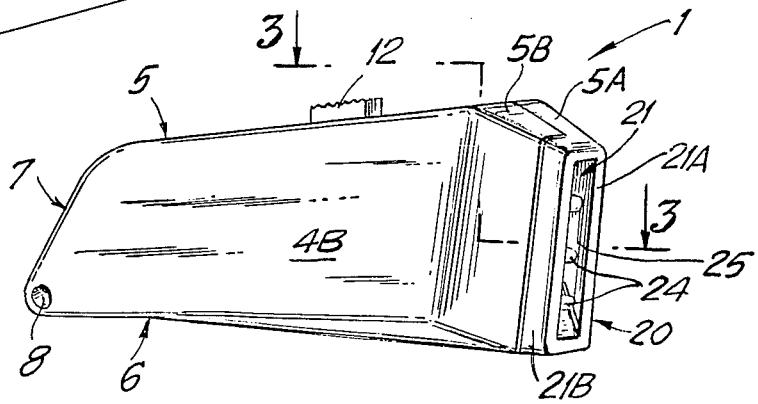
FIG. 2 is a perspective view of the assembled utility knife.
Figure 3:
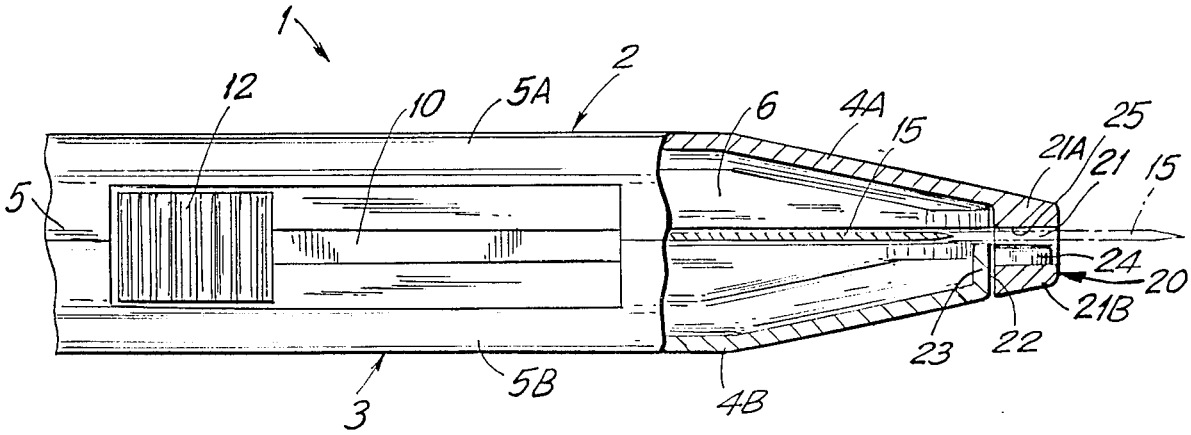
FIG. 3 is a sectional view taken along line 3—3 of FIG. 2.

Referring to the drawings and more particularly to FIG. 1, the utility knife 1 is made from two matching half portions 2–3 having side walls 4–4B. The portions are also provided with top walls 5A–5B, bottom walls 6A–6B and rear walls 7A–7B—each of which will be collectively referred to as the top wall 5, bottom wall 6 and rear wall 7, respectively, when the two portions 2–3 are assembled together to form the utility knife body 1 as shown in FIGS. 2 and 3.

Both portions 2–3 have means (not shown) adapted to receive a screw 9, or some other fastening device, to permit the two portions 2–3 to be held together when assembled to form the utility knife body 1. The rear wall 5 of both portions 2–3 may also have an opening 8 to permit the tool to be hung when not in use.

The upper wall 5 of the body 1 has an elongated slot 10 therein in order to accommodate a blade carrier 11. In the particular embodiment shown in the drawings, the blade carrier 11 has a finger knob 12 extending above the slot 10 with a pusher shaft 13 extending within the slot and within the interior of the body 1. The pusher shaft 13 has the blade holder 14 at its front end adapted to hold a knife blade 15 securely therein. It will be noted that by moving the finger knob 12 forwardly and backwardly, the blade 15 is projected forwardly or retracted backwardly.

At the front end of the body portion 2, there is provided a front wall 20 at right angles to the side wall 4A having an elongated front opening therein forming a mouth 21 comprising mouth walls 21A and 21B. It will be noted that the width of the mouth 21 is much larger than the thickness of the blade 15 so that when the blade 15 is projected through the mouth 21, a space 25 would be left between the blade 15 and the mouth wall 21B of the mouth 21 (FIG. 3).

The fingers 24 preferably comprise a plurality of horizontally oriented spaced fingers which are integral with the inner side wall of the mouth 21B and extend into the space 25. The fingers 24 terminate short of the opposite wall of the mouth 21A and leave sufficient space for the blade 15 to move between the fingers 24 and the opposite wall of the mouth 21A. Hence, when the blade 15 is in an extended position as shown in FIG. 3, the blade 15 will not wobble or sway from side to side.

It will be understood that the use of spaced fingers 24 is the preferred embodiment of the invention. It is possible to achieve the same result by using a solid plate rather than spaced fingers 24 or to have fingers 24 in a different orientation than the ones shown in the drawing or to merely have a plurality of protrusions extending from the side wall 21B.

The other body portion 3 has a solid front wall 23 extending at right angles to the side wall 4B. The front wall 23 is adapted to abut against the rear edge 22 of the mouth 21 which acts as a stop to accurately place the wall 4B in the proper position with respect to side wall 4A so that the two may be assembled together.

As discussed above and as will be seen from FIG. 3, since the fingers 24 fit into and fill the space 25 of the mouth 21, sufficient room is left for the blade 15 to move in and out of the mouth 21 without any obstructions. However, the space between mouth wall 21A and the fingers 24 is narrow enough for the blade 15 to remain steady while in use without bending or angling.

In operation, the two portions 2 and 3 are mounted together and held by a screw 9 as shown in FIGS. 1 and 2 to form the body of the utility knife 1. The front wall 23 abuts rear edge 22 of the mouth portion 21B so that it cooperates therewith to properly position the half 4B.

When in use, the blade 15 is moved forwardly and outwardly through the finger knob 12 and moves between the fingers 24 and the mouth wall 21A and is held steady in that position. Since the front mouth 21 of the body portion 4A cannot spread, there is no danger that the front areas of the mouth will spread apart and cause the blade 15 either to make an improper cut or be accidentally forced out of the body. When the user finishes using the utility knife, the blade 15 is retracted within the body 1.

It will thus be seen that the invention provides an improved utility knife which prevents the front of the mouth-forming portions from spreading apart, in which the two sections of the mouth-forming portions are interlocked with each other in order to prevent them from spreading apart and in which the two halves made into two matching one-piece units which can be easily assembled together.

The embodiments of the invention in which an exclusive property or privilege is claimed are defined as follows:

1. A utility knife comprising a main body formed from a pair of body portions assembled together, one of said body portions having a front wall substantially at right angles thereto, said front wall having an opening therein defining a mouth, said mouth having a pair of opposed side walls the space between said side walls being substantially greater than the width of a blade, and restricting means extending from one of said opposed side walls of said mouth to narrow the space within the mouth so that a blade only may pass between the restricting means and the other of said opposed side walls.

2. A utility knife as set forth in claim 1 wherein said restricting means comprises a finger extending from one side wall of the mouth.

3. A utility knife as set forth in claim 2 wherein a plurality of fingers is provided.

4. A utility knife as set forth in claim 3 wherein a knife blade is retractably mounted within the main body and is adapted to be moved between the fingers and the other side wall of said open mouth.

* * * * *